US007796036B2

(12) United States Patent
Dalzell et al.

(10) Patent No.: US 7,796,036 B2
(45) Date of Patent: Sep. 14, 2010

(54) SECURE CONNECTOR WITH INTEGRATED TAMPER SENSORS

(75) Inventors: William J. Dalzell, Parrish, FL (US); Scott G. Fleischman, Palmetto, FL (US); James L. Tucker, Clearwater, FL (US); Kenneth H. Heffner, Largo, FL (US)

(73) Assignee: Honeywell International Inc., Morristown, NJ (US)

( * ) Notice: Subject to any disclaimer, the term of this patent is extended or adjusted under 35 U.S.C. 154(b) by 688 days.

(21) Appl. No.: 11/565,390

(22) Filed: Nov. 30, 2006

(65) Prior Publication Data

US 2008/0132118 A1 Jun. 5, 2008

(51) Int. Cl.
*G08B 13/12* (2006.01)

(52) U.S. Cl. ..... 340/568.4; 340/568.3; 340/568.2; 340/541; 340/555; 340/686.4; 70/439; 439/207; 439/210

(58) Field of Classification Search ..... 340/657, 340/531, 541, 552, 555, 686.4, 687, 686.1, 340/568.1–568.4, 686.3; 70/439–440
See application file for complete search history.

(56) References Cited

U.S. PATENT DOCUMENTS

| | | | | | |
|---|---|---|---|---|---|
| 2,912,600 | A | * | 11/1959 | Isenberg | 307/328 |
| 3,160,871 | A | * | 12/1964 | Rubinstein | 340/647 |
| 3,610,808 | A | * | 10/1971 | Horwinski | 174/115 |
| 3,633,194 | A | * | 1/1972 | Kothe | 340/550 |
| 3,789,130 | A | * | 1/1974 | Parker | 174/115 |
| 4,002,397 | A | * | 1/1977 | Wang et al. | 439/225 |
| 4,161,348 | A | | 7/1979 | Ulrich | |
| 4,329,681 | A | * | 5/1982 | Parsons | 340/545.6 |
| 4,390,868 | A | * | 6/1983 | Garwin | 340/568.1 |
| 4,447,123 | A | | 5/1984 | Page et al. | |
| 4,523,186 | A | | 6/1985 | Fiarman | |
| 5,026,141 | A | | 6/1991 | Griffiths | |
| 5,117,457 | A | | 5/1992 | Comerford et al. | |
| 5,206,812 | A | | 4/1993 | Abumehdi | |
| 5,418,521 | A | * | 5/1995 | Read | 340/568.3 |
| 5,468,990 | A | | 11/1995 | Daum | |
| 5,506,566 | A | | 4/1996 | Oldfield et al. | |
| 5,541,803 | A | * | 7/1996 | Pope et al. | 361/103 |
| 5,568,124 | A | | 10/1996 | Joyce et al. | |
| 5,675,319 | A | | 10/1997 | Rivenberg et al. | |
| 5,677,769 | A | | 10/1997 | Bendett | |
| 5,821,582 | A | | 10/1998 | Daum | |
| 6,215,397 | B1 | | 4/2001 | Lindskog | |
| 6,232,557 | B1 | * | 5/2001 | Lounsbury et al. | 174/117 F |
| 6,396,400 | B1 | | 5/2002 | Epstein, III et al. | |
| 6,400,268 | B1 | | 6/2002 | Lindskog | |
| 6,692,031 | B2 | | 2/2004 | McGrew | |

(Continued)

FOREIGN PATENT DOCUMENTS

| | | |
|---|---|---|
| DE | 10065747 | 12/2000 |

(Continued)

*Primary Examiner*—Daniel Wu
*Assistant Examiner*—Ryan W Sherwin
(74) *Attorney, Agent, or Firm*—Shumaker & Sieffert, P.A.

(57) ABSTRACT

A secure connector is provided. The secure connector comprises a casing; a tamper sensor disposed inside the casing and configured to detect unauthorized tamper events; and one or more conductors configured to carry signals, the one or more conductors passing through the tamper sensor.

18 Claims, 3 Drawing Sheets

U.S. PATENT DOCUMENTS

| | | | | |
|---|---|---|---|---|
| 6,722,711 | B2 | 4/2004 | Kitzis | |
| 6,838,619 | B1 | 1/2005 | Soyfertis | |
| 6,853,093 | B2 | 2/2005 | Cohen et al. | |
| 6,970,360 | B2 | 11/2005 | Sinha | |
| 7,005,733 | B2 | 2/2006 | Kommerling et al. | |
| 7,015,823 | B1 | 3/2006 | Gillen et al. | |
| 7,021,146 | B2 | 4/2006 | Nash et al. | |
| 7,030,974 | B2 | 4/2006 | Spirin et al. | |
| 7,045,730 | B2 | 5/2006 | Hollar et al. | |
| 7,113,103 | B2 * | 9/2006 | Festa et al. | 340/652 |
| 7,256,692 | B2 | 8/2007 | Vatsaas et al. | |
| 7,429,915 | B2 * | 9/2008 | Cruzado et al. | 340/426.36 |
| 2001/0033012 | A1 | 10/2001 | Kommerling et al. | |
| 2001/0056542 | A1 | 12/2001 | Cesana et al. | |
| 2002/0191788 | A1 | 12/2002 | Inchalik et al. | |
| 2002/0199111 | A1 | 12/2002 | Clark et al. | |
| 2003/0014643 | A1 | 1/2003 | Asami et al. | |
| 2005/0191878 | A1 * | 9/2005 | Castle | 439/76.1 |
| 2007/0120669 | A1 * | 5/2007 | Belden | 340/568.2 |

FOREIGN PATENT DOCUMENTS

| | | |
|---|---|---|
| EP | 0142013 | 5/1985 |
| EP | 0509567 | 10/1992 |
| EP | 0972632 | 1/2000 |
| EP | 1045352 | 10/2000 |
| EP | 1273997 | 1/2003 |
| WO | 9502742 | 1/1995 |
| WO | 9738364 | 10/1997 |
| WO | 0123980 | 4/2001 |

* cited by examiner

SECURE CONNECTOR WITH INTEGRATED TAMPER SENSORS

CROSS-REFERENCE TO RELATED APPLICATIONS

This application is related to co-pending U.S. patent application Ser. No. 11/565,376, filed on Nov. 30, 2006 and Published on Jun. 5, 2008 as U.S. Patent Application Publication No. 2008/0129501, entitled "SECURE CHASSIS WITH INTEGRATED TAMPER DETECTION SENSOR," hereby incorporated herein by reference, and referred to herein as the "'12756 Application".

This application is related to co-pending U.S. patent application Ser. No. 11/565,361, filed on Nov. 30, 2006 and Published on Jun. 5, 2008 as U.S. Patent Application Publication No. 2008/0134349, entitled "CARD SLOT ANTI-TAMPER PROTECTION," hereby incorporated herein by reference, and referred to herein as the "'13121 Application".

BACKGROUND

Electronics systems and products containing proprietary information are subject to the risk of unauthorized examination at all levels of assembly including a closed chassis. A broad range of reverse engineering methods can be applied to obtaining unauthorized access to the confidential internal workings, data, etc. inside such a chassis. Such methods include removing access panels, drilling, or other means of gaining access to the proprietary information residing inside the chassis.

Protective methods and apparatus are used to delay the success of such reverse engineering attempts. However, given the necessary resources and time, these methods can be defeated. A known, successful reverse engineering attack renders the protective method or apparatus vulnerable to future attacks, and thereby ends the usefulness. New methods and apparatus are, therefore, needed to detect and/or thwart reverse engineering attacks on systems with proprietary property.

SUMMARY

The present invention described in the following specification provides a protective apparatus that addresses the need for improved anti-tamper protection in chassis-level systems.

In one embodiment, a secure connector is provided. The secure connector comprises a casing; a tamper sensor disposed inside the casing and configured to detect unauthorized tamper events; and one or more conductors configured to carry signals, the one or more conductors passing through the tamper sensor.

DRAWINGS

The present invention can be more easily understood and further advantages and uses thereof more readily apparent, when considered in view of the description of the following figures in which.

Like reference numbers and designations in the various drawings indicate like elements.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

Embodiments of the present invention provide secure connectors configured to detect unauthorized tamper events. Conventional connectors often provide a way for reverse engineers to gain access to a chassis that is otherwise protected. Embodiments of the present invention, however, detect attempts to gain access through a secure connector. Secure connectors according to embodiments of the present invention are configured to fit the footprint of conventional connectors which enables a low cost method of increasing protection of a system without replacing the entire system.

Figure 1A:
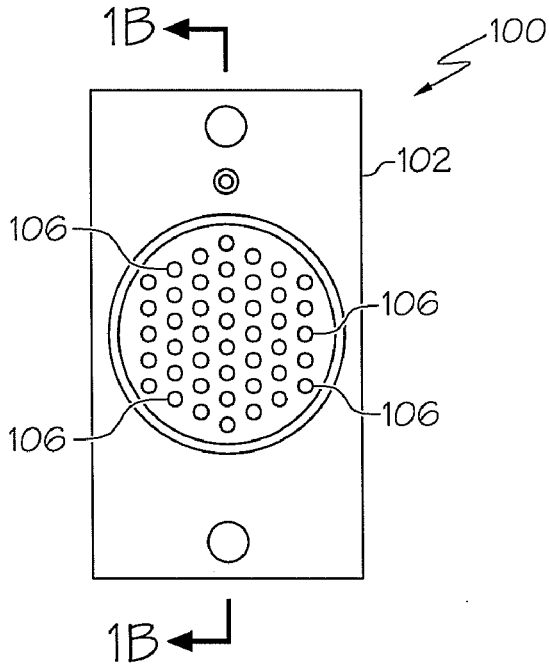
FIG. 1A is a front view of a secure connector according to one embodiment of the present invention.
Figure 1B:
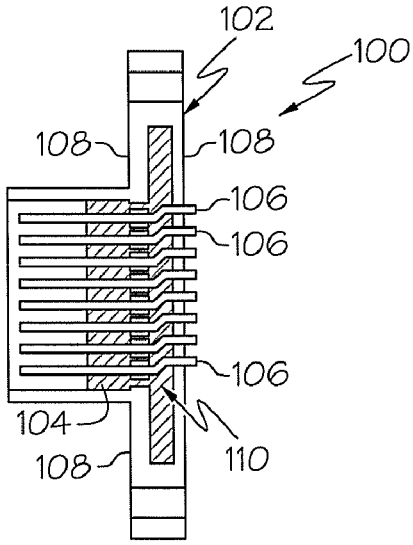
FIG. 1B is a cross-sectional side view of the secure connector of FIG. 1A.

FIGS. 1A and 1B depict a secure connector 100 according to one embodiment of the present invention. Secure connector 100 includes a housing 102, a tamper sensor 104, and a plurality of conductors 106 configured to conduct signals. In the embodiment shown in FIG. 1, conductors 106 comprise pins configured to carry electrical signals. However, it is to be understood that in other embodiments, conductors 106 can be configured to conduct optical signals. In addition, the term "pin" as used herein refers to any electrically conductive terminal.

In this example, casing 102 comprises a plurality of sides 108 which are configured to form an enclosure 110. As shown in FIG. 1B, tamper sensor 104 is disposed within enclosure 110 such that an unauthorized tamper event is detected by tamper sensor 104. In this way, tamper sensor 104 provides a detection barrier substantially throughout enclosure 110 of connector 100. Notably, although a plurality of conductors 106 are shown in FIG. 1, it is to be understood that in other embodiments, one conductor can be used.

Tamper sensor 104 is configured to detect unauthorized tamper events. Unauthorized tamper events include, but are not limited to, removing access panels, drilling, or other means of gaining access to sensitive equipment or electronic components. For example, in some embodiments, tamper sensor 104 is a fiber optic matrix which is configured to detect interference with the light traveling through the fiber optic matrix. In such embodiments, drilling through the fiber optic matrix, for example, will disrupt the light in the fiber optic matrix. The disruption will trigger a detected tamper event. In other embodiments, tamper sensor 104 is an electrical sensor configured to detect changes in electrical properties, e.g. resistance, due to unauthorized tamper events such as excessive pressure on tamper sensor 104. It is to be understood that tamper sensor 104 can be implemented as any appropriate type of sensor configured to detect unauthorized tamper events.

As shown in FIG. 1B, conductors 106 pass through tamper sensor 104. As stated above, conductors 106, in this example, comprise pins configured to carry electrical signals (including power in some embodiments). Conductors 106, therefore, electrically couple two devices together in this example, as known to one of skill in the art. Notably, although conductors 106 are shown as round (cylindrical) in this example, other embodiments of the present invention are not so limited. In particular, it is to be understood that any appropriate pin configuration and shape can be used in various embodiments of the present invention. For example, pins 106 can be flat or replaced with female socket contacts, etc., in other embodiments. Similarly, it is to be understood that any appropriate connector configuration can be used. For example, connector 100 can be implemented as, but not limited to, a modular connector (e.g. 8P8C, 6P6C, etc.), universal serial bus (USB) connector, D-subminiature connector, DIN connector, optical connector configurations, Joint Test Action Group (JTAG) connectors, etc.

Passing through tamper sensor 104 enables conductors 106 to couple two devices together as in conventional connectors. However, connector 100, although appearing to be a conventional connector in some embodiments, includes tamper sensor 104 which detects tamper events including attempts to tamper with conductors 106. For example, as shown in FIG. 1B, conductors 106 are bent inside tamper sensor 104. An attempt to remove one of conductors 106, such as by drilling or pulling out the conductor, will be detected by tamper sensor 104 due to the bend in conductors 106. In addition, casing 102 is configured, in some embodiments, to crack or break under excessive pressure applied to conductors 106, thereby causing the tamper event to be detected by tamper sensor 104.

In operation, conductors 106 carry electrical signals (or optical signals in other embodiments) as in conventional connectors. However, when an attempt is made to gain unauthorized access to sensitive components or data by tampering with connector 100, tamper sensor 104 detects the unauthorized tamper event and signals its detection to a monitoring device (shown in FIG. 2) that is coupled to tamper sensor 104. The monitoring device then takes protective measures. For example, the monitoring device can erase data, encrypt data, physically destroy components, etc. The protective response initiated by the monitoring device can vary and depends on the data or components being protected and the system in which connector 100 is used.

As described above, connector 100 can be implemented with any appropriate connector configuration. As can be seen in FIG. 1A, connector 100 appears to be a conventional non-secure connector (e.g. a conventional USB connector, modular connector, etc. without a tamper sensor). In fact, casing 102 of connector 100 is configured to fit the footprint of a similar conventional connector. Connector 100 can be used, therefore, to replace non-secure conventional connectors without requiring additional adaptations to systems currently using the non-secure connectors.

Due to the conventional appearance, a reverse engineer is unlikely to be aware of tamper sensor 104 located on the inside of connector 100. Hence, the conventional appearance of embodiments of the present invention is an added benefit because reverse engineers are also less likely to attempt to circumvent tamper sensor 104 which increases the probability that tamper sensor 104 will detect an unauthorized tamper event.

Figure 2:
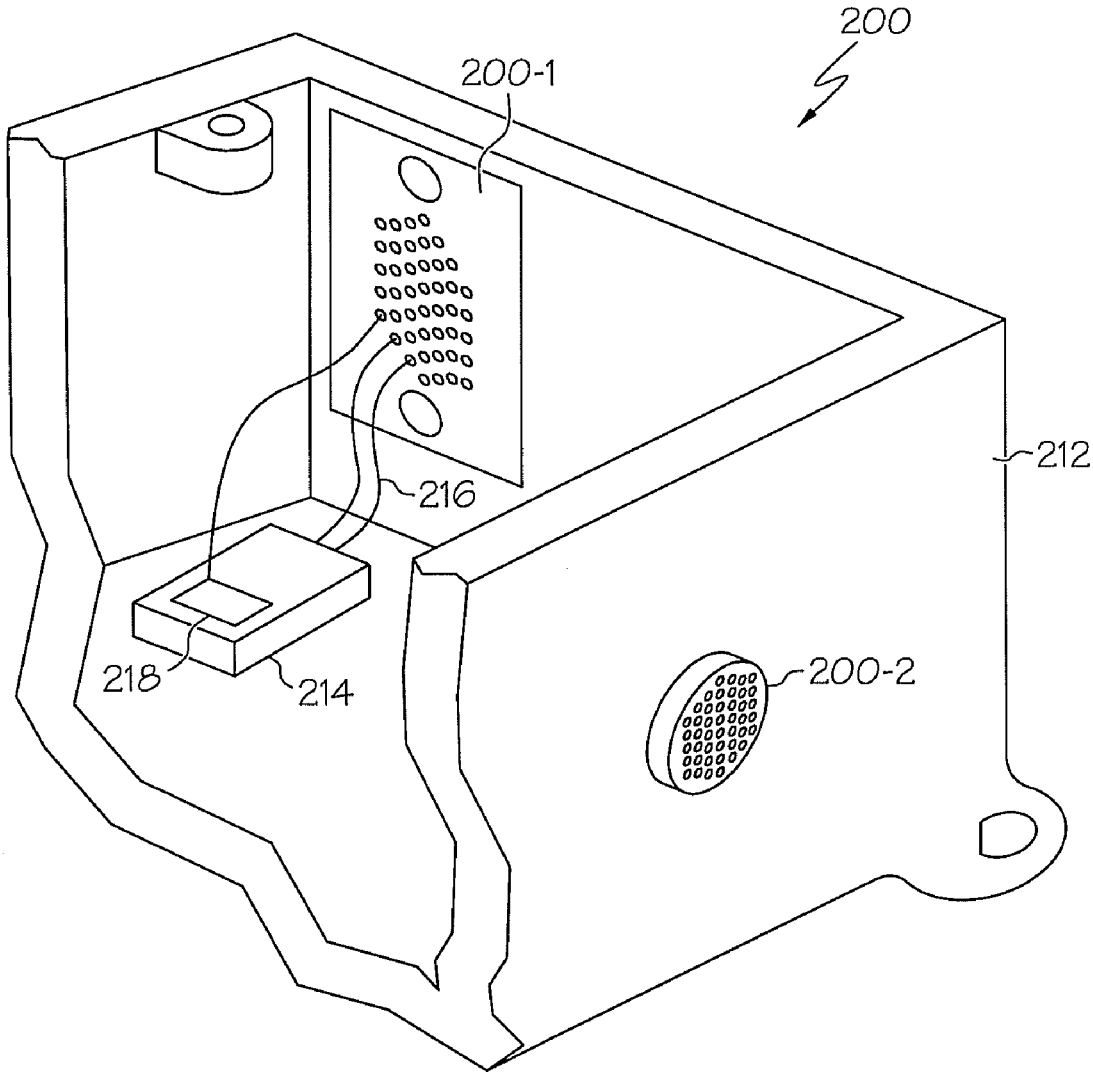
FIG. 2 is an elevated perspective view depicting secure connectors used in a chassis according to one embodiment of the present invention.

FIG. 2 is an elevated perspective view depicting secure connectors 200 used in a chassis 212 according to one embodiment of the present invention. As can be seen in FIG. 2, connectors 200 appear to be conventional connectors as discussed above. However, each of connectors 200 includes a tamper sensor (e.g. tamper sensor 104) inside an enclosure formed by the sides of connectors 200, as described above. Connectors 200 couple one or more devices located inside chassis 212 to one or more devices located outside chassis 212. For example, connector 200-1 is coupled to device 214 inside chassis 212 via cable 216. A device coupled to connector 200-1 outside chassis 212 is, therefore, coupled to device 214 by connector 200-1. Connector 200-1 is also coupled to monitoring device 218. In particular, the tamper sensor in connector 200-1 is coupled to monitoring device 218.

It is to be understood that although connector 200-1 is coupled to device 214 in this example, other embodiments of the present invention are not so limited. In particular, connector 200-1 can be connected to monitoring device 218 only. Similarly monitoring device 218 can be coupled to device 214 using any appropriate technique known to one of skill in the art. In addition, in some embodiments, connectors 200-1 and 200-2 are each configured with a connection point (shown in FIG. 3) which is configured to coupled connectors 200-1 and 200-2 together. For example, in this embodiment, a wire runs through a wall of chassis 212 and connects to the connection point of each of connectors 200-1 and 200-2. Alternatively, a wire can be run along an inside surface of chassis 212 to couple connectors 200-1 and 200-2 together.

If the tamper sensor detects an unauthorized tamper event, it signals the detection of the tamper event to monitoring device 218. Monitoring device 218 is configured to initiate protective measures in response to a detected tamper event. For example, in some embodiments, monitoring device 218 erases or encrypts data on device 214. In other embodiments, monitoring device 218 physically destroys device 214. As described above, the protective measures initiated depend on the device to be protected and the application in which connectors 200 are being used.

Figure 3:
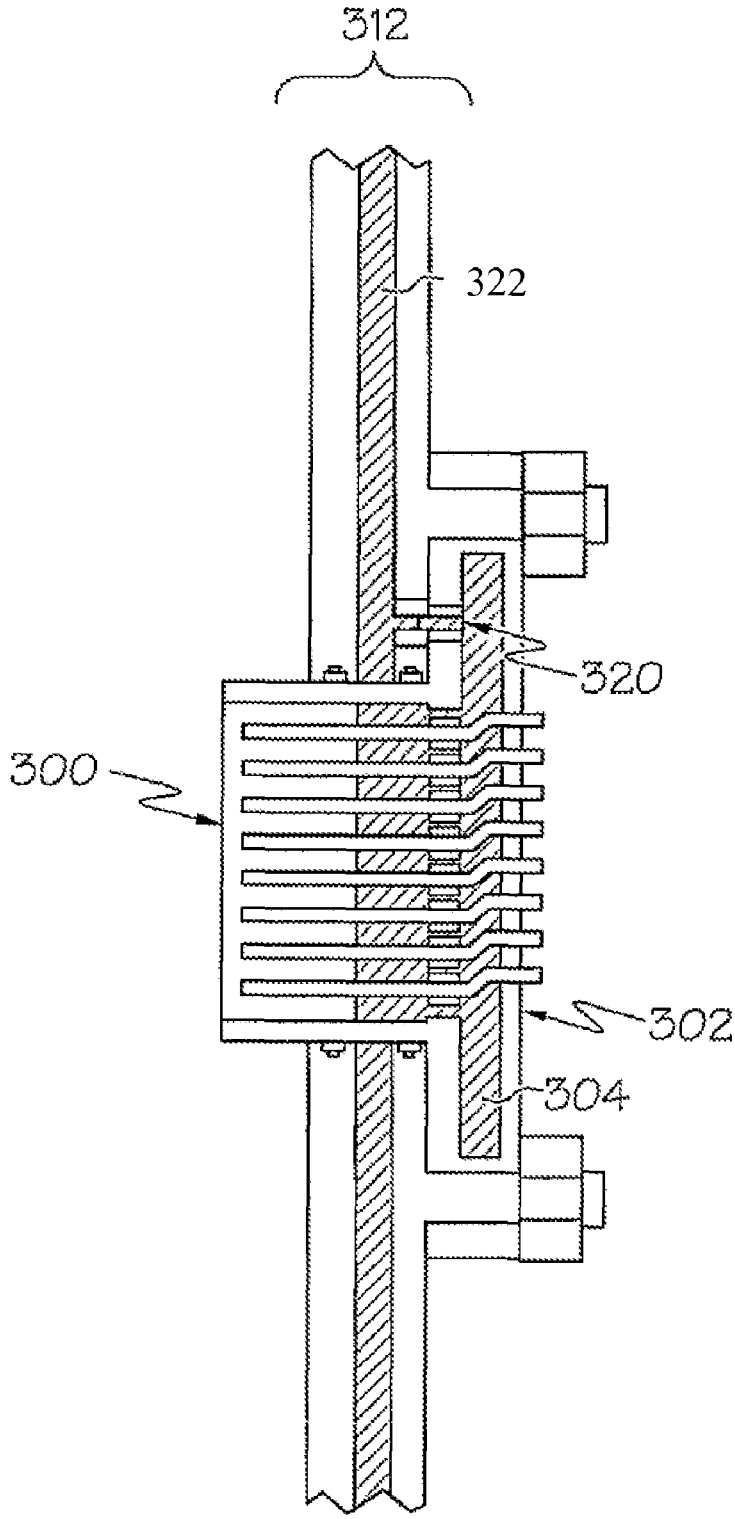
FIG. 3 is a cross-sectional side view depicting a secure connector coupled to a secure chassis according to another embodiment of the present invention.

FIG. 3 is a cross-sectional side view depicting a secure connector 300 coupled to a secure chassis 312 according to another embodiment of the present invention. A description of a secure chassis is provided in co-pending U.S. patent application Ser. No. 11/565,376, filed on Nov. 30, 2006 and incorporated herein by reference. Connector 300 is configured with connection point 320 which couples tamper sensor 304 to a tamper sensor in a second component. In this example, the second component is secure chassis 312 having tamper sensor 322. In such embodiments, continuity is provided between tamper sensors 322 and 304. For example, connection point 320 can include, but is not limited to, a mechanical optocoupler or a fusion of the termini of two optical fibers extending from tamper sensors 304 and 322. This continuity increases the security provided by connector 300 and chassis 312 by eliminating a potential gap in detection which could be exploited by a reverse engineer. In other embodiments, the second component can be a second secure connector or other secure device.

It is to be understood that connector 300 can be used with any type of chassis and is not required to be used with secure chassis 312. In particular, connector 300 can be used in a non-secure chassis to provide increased protection by simply replacing non-secure connectors in the non-secure chassis. For some systems, it is cost prohibitive to replace the chassis. However, by replacing the non-secure connectors with secure connector 300, security of the system is still increased at a lower cost.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A secure connector comprising:

a casing;

a tamper sensor disposed inside the casing and configured to detect unauthorized tamper events; and one or more conductors configured to carry signals, the one or more conductors passing through the tamper sensor, wherein the casing includes a contact which couples the tamper sensor in the secure connector to a tamper sensor in another component external to the secure connector.

2. The secure connector of claim 1, wherein at least a portion of each of the one or more conductors passing through the tamper sensor is bent.

3. The secure connector of claim 1, wherein the tamper sensor comprises one of a fiber optic matrix or an electrical sensor configured to detect changes in electrical characteristics.

4. The secure connector of claim 1, wherein the one or more conductors are configured to carry one of electrical signals or optical signals.

5. The secure connector of claim 1, wherein the casing is configured to crack when excessive force is applied to at least one of the one or more conductors.

6. The secure connector of claim 1, wherein the casing and the one or more conductors are configured as one of a modular connector, a universal serial bus (USB) connector, a D-subminiature connector, a DIN connector, a Joint Test Action Group (JTAG) connector, or an optical connector.

7. The secure connector of claim 1, wherein the one or more conductors are configured as one of cylindrical conductors, flat conductors, or female socket contacts.

8. An electrical system comprising:

at least one secure connector comprising:

a casing;

a tamper sensor disposed inside the casing configured to detect unauthorized tamper events; and one or more conductors configured to carry signals, the one or more conductors passing through the tamper sensor, wherein the casing includes a connection point configured to couple the tamper sensor in the at least one secure connector to a tamper sensor in another secure connector;

a chassis configured to engage the at least one secure connector such that an end of each of the one or more conductors is accessible outside the chassis; and a monitoring device coupled to the tamper sensor and configured to control a response to unauthorized tamper events detected by the tamper sensor.

9. The electrical system of claim 8, wherein at least a portion of each of the one or more conductors passing through the tamper sensor is bent.

10. The electrical system of claim 8, wherein the tamper sensor comprises one of a fiber optic matrix or an electrical sensor configured to detect changes in electrical characteristics.

11. The electrical system of claim 8, wherein the one or more conductors are configured to carry one of electrical signals and optical signals.

12. The electrical system of claim 8, wherein the casing is configured to crack when excessive force is applied to at least one of the one or more conductors.

13. The electrical system of claim 8, wherein the at least one secure connector is configured as one of a modular connector, a universal serial bus (USB) connector, a D-subminiature connector, a DIN connector, a Joint Test Action Group (JTAG) connector, or an optical connector.

14. The electrical system of claim 8, wherein the monitoring device, in response to a detected tamper event, is configured to control one of encryption of data on a device inside the chassis, erasure of data on a device inside the chassis, and physical destruction of a device inside the chassis.

15. The electrical system of claim 8, wherein the one or more conductors are configured as one of cylindrical conductors, flat conductors, or female socket contacts.

16. The electrical system of claim 8, wherein the at least one secure connector further comprises a connection point configured to couple the tamper sensor in the at least one secure connector to a tamper sensor in the chassis.

17. A secure connector comprising:

a casing;

a tamper sensor disposed inside the casing and configured to detect unauthorized tamper events, wherein the tamper sensor comprises one of a fiber optic matrix or an electrical sensor configured to detect changes in electrical characteristics; and one or more conductors configured to conduct one of electrical or optical signals, the one or more conductors passing through the tamper sensor, wherein a section of at least one of the one or more conductors disposed in the tamper sensor is bent, wherein the casing includes a contact which couples the tamper sensor in the secure connector to a tamper sensor in another component external to the secure connector.

18. The secure connector of claim 17, wherein the casing and the one or more conductors are configured as one of a modular connector, a universal serial bus (USB) connector, a D-subminiature connector, a DIN connector, a Joint Test Action Group (JTAG) connector, or an optical connector.

* * * * *